United States Patent [19]

Hooton

[11] 4,268,082

[45] May 19, 1981

[54] ELEVATOR LATCH FOR DRILLING RIGS

[76] Inventor: Frank W. Hooton, 715 N. Jefferson, Casper, Wyo. 82601

[21] Appl. No.: 34,176

[22] Filed: Oct. 24, 1979

[51] Int. Cl.[3] ..... B66C 1/10; E21B 19/06

[52] U.S. Cl. ..... 294/88; 294/90

[58] Field of Search ..... 294/88, 90, 102 A; 24/249 DP; 414/22, 626, 745

[56] References Cited

U.S. PATENT DOCUMENTS

| | | | |
|---|---|---|---|
| 2,684,166 | 7/1954 | De Jarnett | 294/90 X |
| 2,692,059 | 10/1954 | Bolling | 414/22 |
| 2,695,189 | 11/1954 | Chrisman et al. | 294/90 |

FOREIGN PATENT DOCUMENTS

| | | | |
|---|---|---|---|
| 2000760 | 7/1971 | Fed. Rep. of Germany | 294/88 |
| 959929 | 6/1964 | United Kingdom | 294/88 |

*Primary Examiner*—Johnny D. Cherry

*Attorney, Agent, or Firm*—Schuyler, Banner, Birch, McKie & Beckett

[57] ABSTRACT

An automatic elevator latch is connected to the elevator of a drilling rig for automatically clamping the drill stem or pipe of the drilling rig. The automatic elevator latch includes a pair of arms connected to the elevator for closing the elevator. The arms are responsive to the operation of a pair of air pots, each of which includes a plunger which moves one of the arms forward on each side of the elevator to close the elevator. The air pots are in turn responsive to a compressed air system which is operated by the derrickman to automatically close the elevator. As a result, the automatic elevator latch of the present invention enables the derrickman to quickly, efficiently and safely close the elevator of a drilling rig.

9 Claims, 6 Drawing Figures

ELEVATOR LATCH FOR DRILLING RIGS

BACKGROUND OF THE INVENTION

The present invention is directed to an automatic elevator latch for automatically latching the pipe elevator of a rotary drilling rig.

As a result of the recent energy crises and the need for greater quantities of oil and gas, it is necessary to drill at great depths to discover oil and gas resources. In order to drill at such great depths, very large drilling rigs have been constructed. As a result, the pipe elevators of these large drilling rigs are usually located five to twenty feet above the derrickman's head at the time when these pipe elevators need to be latched or closed.

At the present time, pipe elevators are manually latched by the derrickman by climbing above the derrickboard to the location of the pipe elevator at the time it must be latched. The derrickman must take off his safety belt to climb a sufficient height to manually latch the pipe elevator. The disadvantage of this manual latching technique is that it is both dangerous and time consuming.

SUMMARY OF THE INVENTION

The primary object of the present invention is to provide a safe apparatus for enabling a derrickman to latch a pipe elevator of a rotary drilling rig in a short period of time. In this regard, it is an object of the present invention to provide an automatic elevator latch which can be operated by the derrickman without disengaging his safety belt and without climbing above the derrickboard to manually latch the pipe elevator.

It is a further object of the present invention to provide an automatic elevator latch which is simple to operate and is relatively inexpensive to install and maintain.

According to the present invention, a pipe elevator is automatically operated by an elevator latch which is directly controlled by the derrickman by operation of a compressed air system. The elevator latch includes a pair of arms fastened on each side of the pipe elevator. These arms are responsive to a pair of air pots which form part of the compressed air system. Each of the air pots includes a plunger which engages one of the arms connected to each side of the pipe elevator to close the pipe elevator upon operation of the air pots. The air pots are connected to a source of compressed air which is controlled by the derrickman through a compressed air hose which runs from the air pots to the location of the derrickman. When it is necessary to close the pipe elevator, the derrickman merely turns on the compressed air in the air hose which forces the air pots to close the pipe elevator through the arms of the elevator latch. As a result, it is unnecessary for the derrickman to leave the derrickboard in order to effectively and quickly close the pipe elevator during operation of the drilling rig.

DETAILED DESCRIPTION OF THE INVENTION

Figure 1:
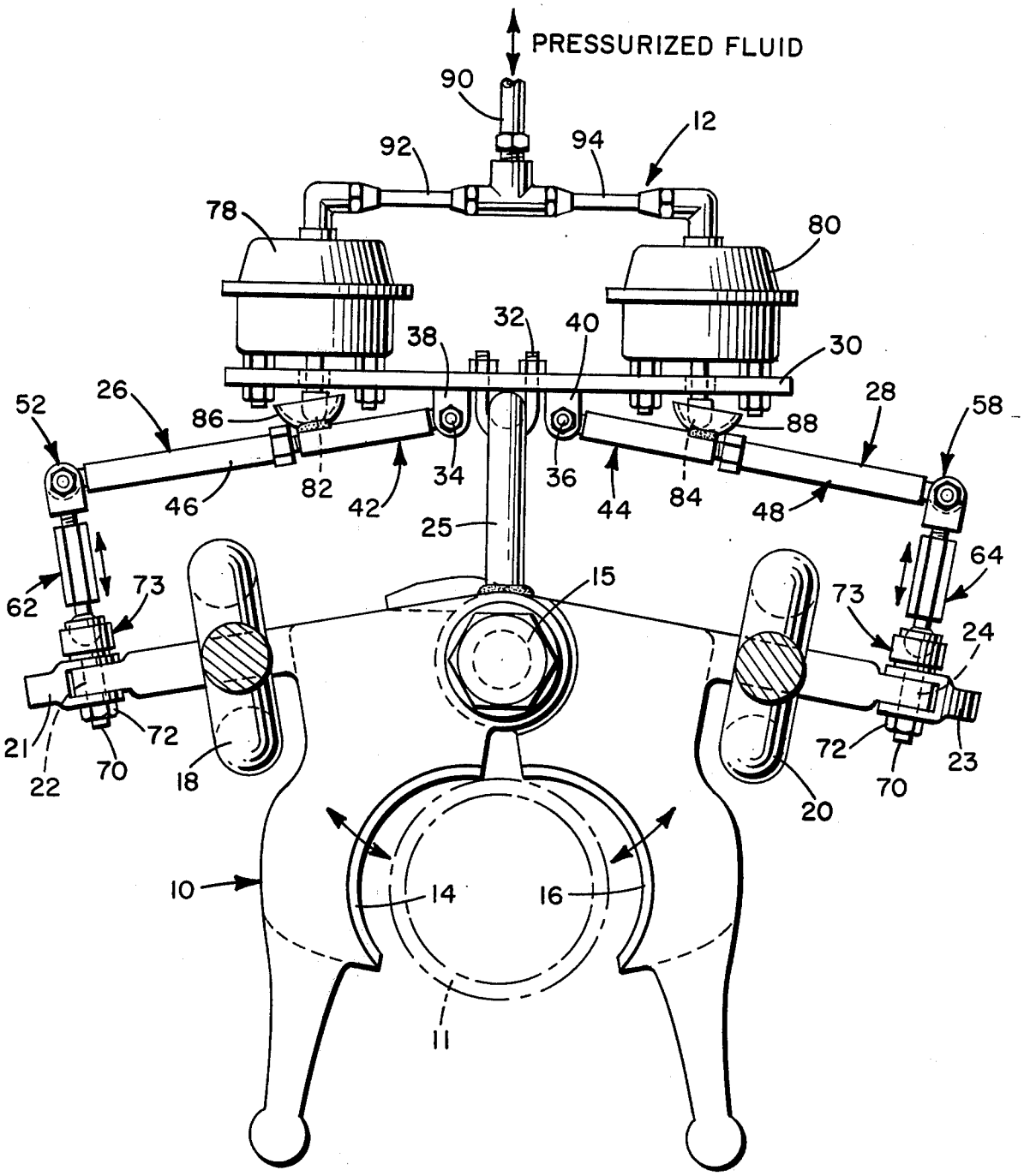
FIG. 1 is a top plan view of an elevator with the elevator latch of the present invention.

Referring now to the drawings, a conventional elevator 10 of a rotary drilling rig is illustrated in FIG. 1 connected to the elevator latch 12 of the present invention. The elevator 10 includes two pivotable sections or gripping jaws 14 and 16 which can be pivoted about hinge bolt 15 to clamp a drill stem or pipe 11. The elevator sections 14 and 16 are supported by a pair of eye hooks 18 and 20 which are raised and lowered by the traveling block which raises and lowers the drill stem or pipe after the elevator sections 14 and 16 clamp the drill stem or pipe. The elevator 10 is usually located above the derrickman at a height of approximately 5–20 feet at the time it is necessary to close or clamp the elevator sections 14 and 16 on the drill stem or pipe.

Figure 2:
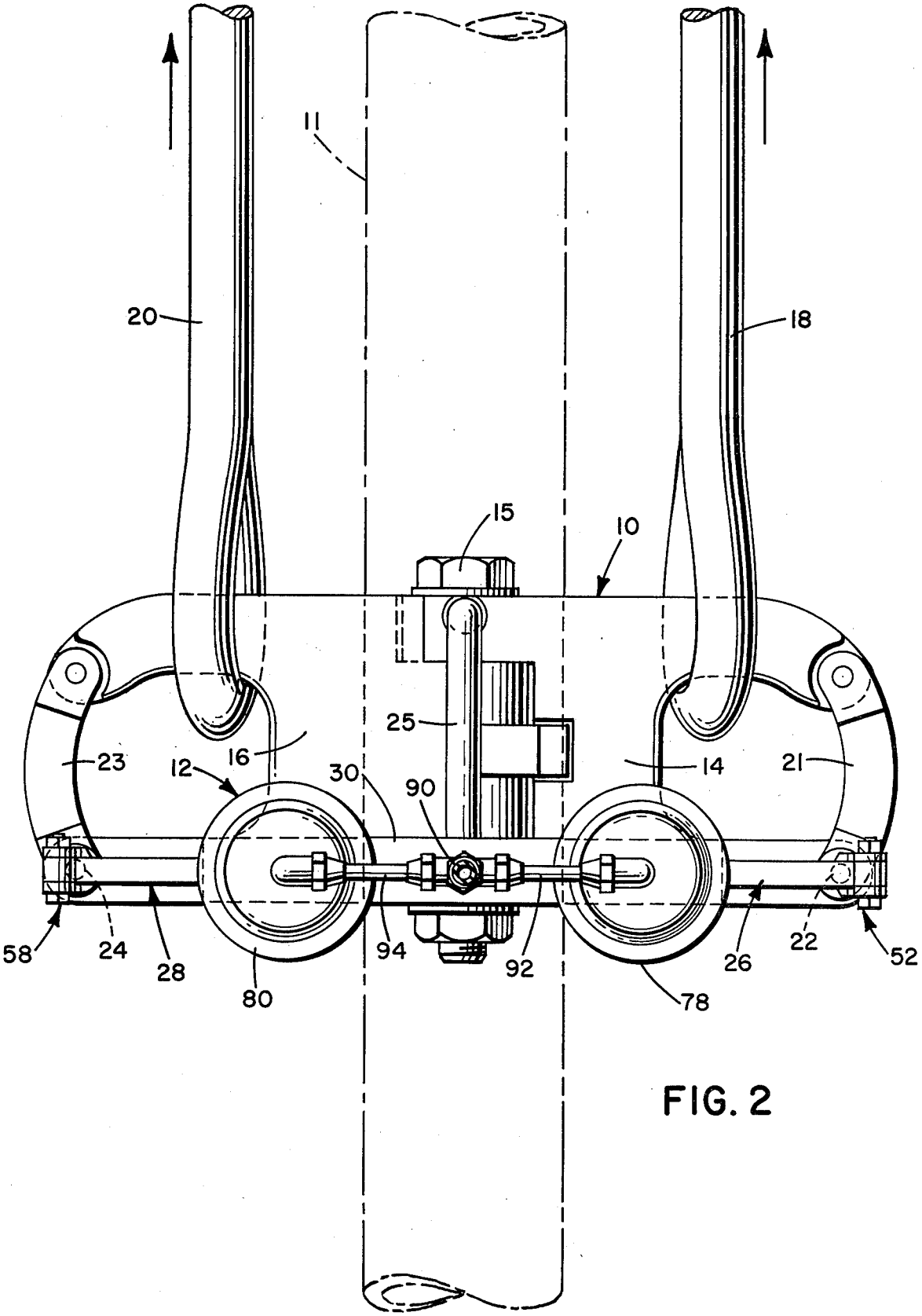
FIG. 2 is a rear elevation of the elevator latch attached to an elevator.
Figure 3:
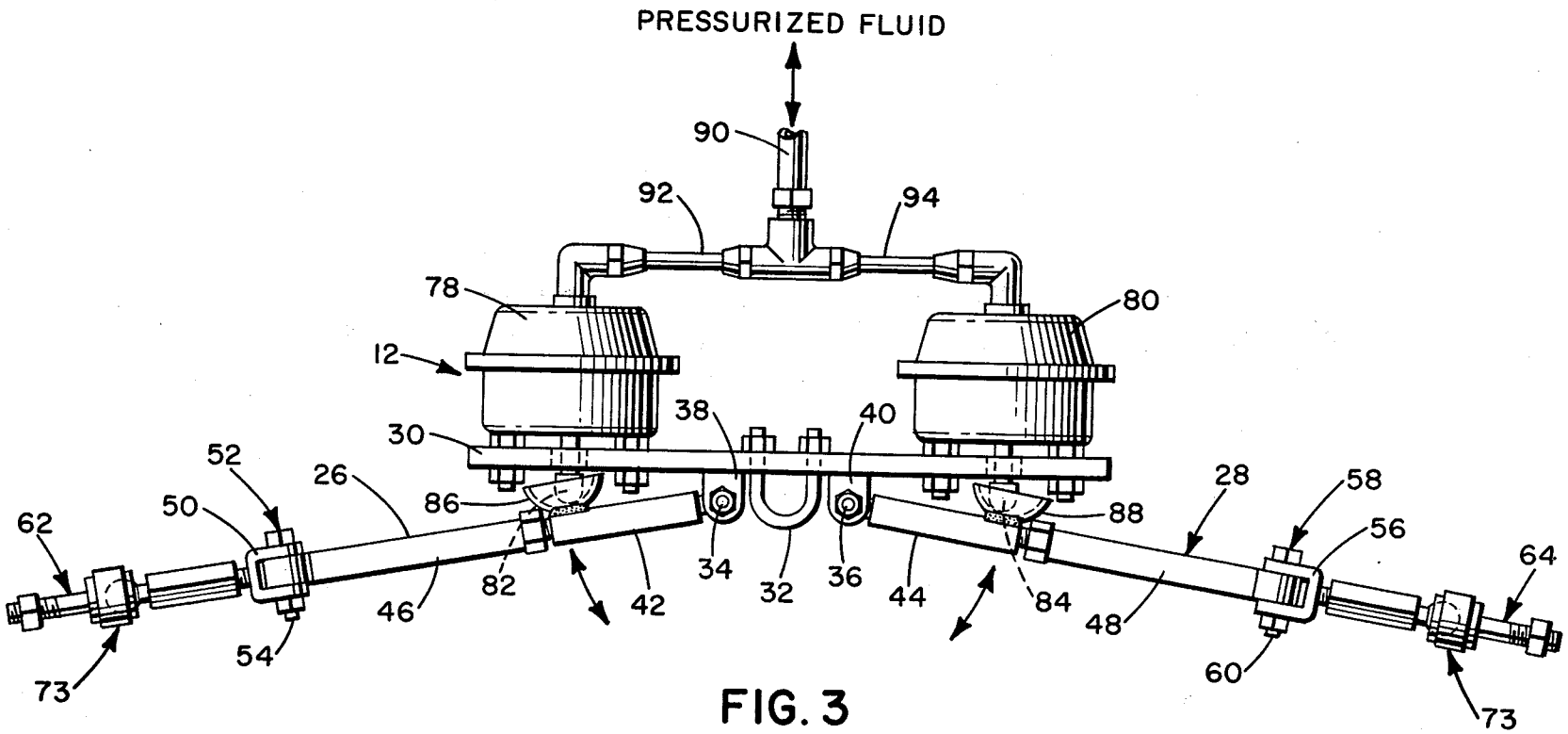
FIG. 3 is a top plan view of the elevator latch of the present invention.

The elevator latch 12 is an automatic closing device for the elevator 10 of FIG. 1. A rear elevational view of the elevator latch 12 and elevator is shown in FIG. 2. The elevator latch 12 is connected to the elevator 10 at the bottom pivot holes 22 and 24 of the eye hook latches 21 and 23 of the elevator 10. The elevator latch 12 automatically closes section or jaws of the elevator 10 in response to a compressed air system which is operated by the derrickman. As a result of the operation of the compressed air system, the derrickman can close or clamp the elevator 10 on the drill stem or pipe without leaving the derrickboard.

Figure 4:
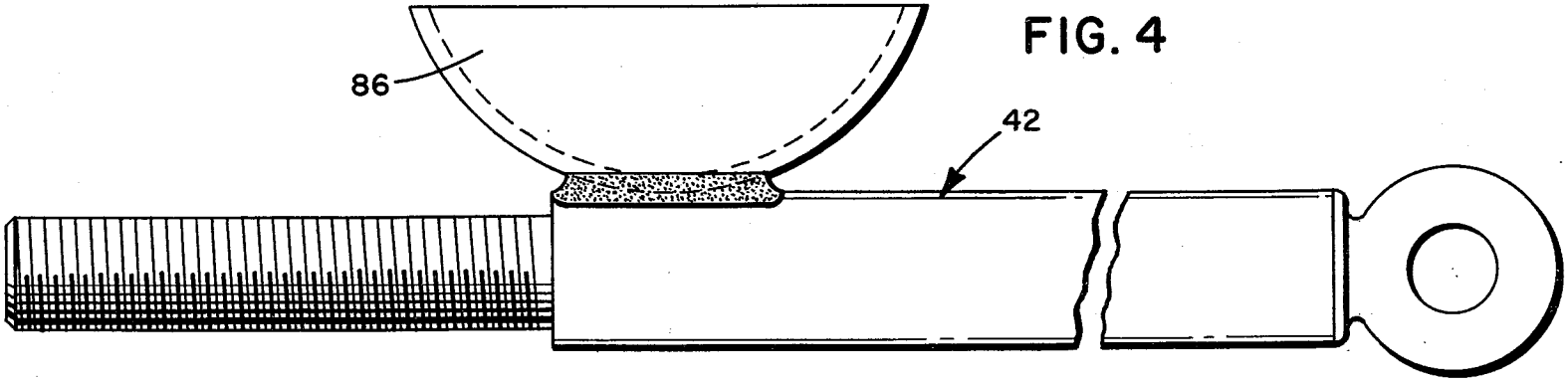
FIG. 4 is a top plan view of the pivot rod and guide cup of the elevator latch shown in FIG. 3.
Figure 5:
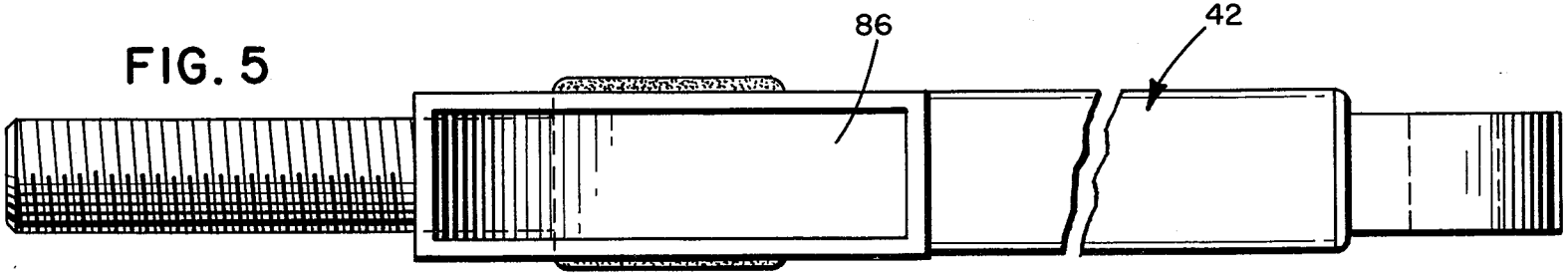
FIG. 5 is a front elevational view of the pivot rod and guide cup shown in FIG. 3.

The elevator latch 12 includes a mounting plate 30 and a U-shaped mounting bolt 32 connected thereto which connects the elevator latch 12 to the rear handle 25 of the elevator 10 in the manner illustrated in FIGS. 1 and 2. The arms 26 and 28 of the elevator latch 12 are pivotably connected to the mounting plate 30 by bolts 34 and 36 which extend through brackets 38 and 40 fastened to the mounting plate 30. Pivot rods 42 and 44, one of which is shown in greater detail in FIGS. 4–5, form the first portion of the arms 26 and 28, respectively. These pivot rods 42 and 44 are pivotably connected by the bolts 34 and 36 to the brackets 38 and 40. Each arm 26 and 28 of the elevator latch 12 includes an extension rod 46 or 48 which is bolted at one end to the pivot rods 42 or 44. The other end of the extension rod 46 contains an opening for fastening a U-shaped bracket 50 to the extension rod 46 at joint 52 by bolt 54. Similarly, a U-shaped bracket 56 is fastened to extension rod 48 at joint 58 by bolt 60. These joints 52 and 58 permit the ends of the arms 26 and 28 to pivot around the elevator 10 as best illustrated in FIG. 1.

Figure 6:
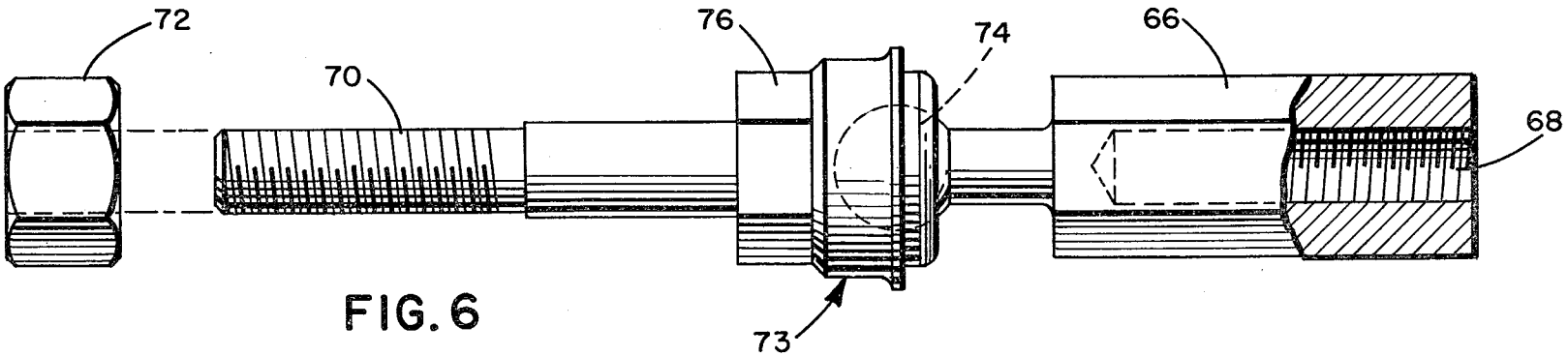
FIG. 6 is a plan view of the elevator bolt and ball joint of the elevator latch shown in FIG. 3.

The arms 26 and 28 of the elevator latch 12 are connected to the elevator 10 by elevator couplings 62 and 64, one of which is shown in greater detail in FIG. 6. Since these elevator couplings 62 and 64 are identical, identical elements will be designated by the same reference numerals. The elevator couplings 62 and 64 are fastened to the brackets 50 and 56 by a threaded portion 66 which contains interior threads 68. The other ends of the elevator couplings 62 and 64 are bolted by bolt 70 and nut 72 to the bottom pivot holes 22 and 24 of the eye hook latches 21 and 22, respectively. The threaded portion 66 and the bolt 70 are connected to each other by a ball joint 73. One end of the threaded portion 66 forms the ball 74 and the bolt 70 contains the socket 76 of the ball joint 73. The ball joints 73 permit the elevator couplings 62 and 64 to rotate as the arms 26 and 28 force the elevator 10 to close or clamp on the drill stem or pipe.

A pair of air pots 78 and 80 are also mounted on the mounting plate 30. These air pots 78 and 80 are conventional; air pots such as the Model TSE2400 air pots manufactured by Wagner Lockhead. The air pots 78 and 80 contain plungers 82 and 84 which pass through suitable holes in mounting plate 30 and which engage guide cups 86 and 88, respectively, on the arms 26 and 28 of the elevator latch 12. The plunger 82 extends into a guide cup 86 mounted on the pivot rod 42 to move the arm 26 to close the elevator latch 12. Similarly, the plunger 84 extends into a guide cup 88 to move the other arm 28 of the elevator latch 12. The plungers 82 and 84 of the air pots 78 and 80 are responsive to compressed air to push these plungers 82 and 84 into the guide cups 86 and 88. A source of compressed air is connected to the air pots 78 and 80 by an air hose 90 and air tubes 92 and 94. The other end of the air hose 90 extends to the location of the derrickman on the derrickboard. Compressed air for operating the air pots 78 and 80 is controlled by an air valve (not shown) connected to the air hose 90 and operated by the derrickman.

The operation of the elevator latch of the present invention is apparent from the above description. When it is necessary to clamp or close the elevator 10, the derrickman turns on the compressed air which passes through the air hose 90 to the air pots 78 and 80. The plungers 82 and 84 of the air pots 78 and 80 are forced outward by the air pressure and push against and into the guide cups 86 and 88. These guide cups 86 and 88 are attached to the arms 26 and 28 of the elevator latch 12. As a result, these arms 26 and 28 are pushed forward to close the sections or jaws 14 and 16 into gripping contact with the drill pipe 11 shown in phantom lines. The ends of the arms 26 and 28 pivot at the ball joint 73 of each of the elevator couplings 62 and 64 to push against the sides of the elevator 10 to close the elevator sections 14 and 16 which pivot about hinge bolt 15 to clamp the drill stem or pipe. Thus, the elevator 10 can be automatically operated by the elevator latch 12 of the present invention with speed, efficiency and safety.

Although illustrative embodiments of the invention have been described in detail with reference to the accompanying drawings, it is to be understood that the invention is not limited to those precise embodiments and that various changes and modifications may be affected therein by one skilled in the art without departing from the scope or spirit of the invention.

I claim:

1. In a drilling rig having an elevator for raising and lowering drill stems and pipes, said elevator having a pair of pivotable sections to clamp said drill stems and pipes and a back handle, elevator latching means removably attached to said elevator and responsive to an operator for automatically closing said elevator to clamp said drill stems and pipes, said elevator latching means comprising:

mounting means removably attached to said back handle of said elevator for mounting said elevator latching means on said elevator;

arm means pivotably mounted on said mounting means and removably fastened to said pivotable sections of said elevator for closing said elevator;

driving means coupled to said arm means for driving said arm means; and operator control means connected to said driving means and responsive to the operator for automatically actuating said driving means to close said elevator on said drill stems and pipes.

2. In a drilling rig according to claim 1, said arm means comprising a pair of arms pivotably mounted on said mounting means, one of said arms being fastened to each of said pair of pivotable sections of said elevator.

3. In a drilling rig according to claim 2 wherein said driving means comprises a pair of air pots, one of which is associated with each of said arms, said air pots having plungers coupled to said arms to drive said arms forward, said operator control means comprising air supply means under operator control for supplying air to said air pots.

4. In a drilling rig according to claim 2 wherein each of said arms includes pivoting means for pivoting said arms around said elevator.

5. In a drilling rig having an elevator for raising and lowering drill stems and pipes, elevator latching means responsive to an operator for automatically closing said elevator to clamp said drill stems and pipes, said elevator latching means comprising:

mounting means for mounting said elevator latching means on said elevator;

arm means pivotably mounted on said mounting means and fastened to said elevator for closing said elevator; said arm means comprising a pair of arms pivotably mounted on said mounting means, one of said arms being fastened to each side of said elevator, each of said arms including pivoting means for pivoting said arms around said elevator; said pivoting means comprising a ball and socket adjacent each side of said elevator;

driving means coupled to said arm means for driving said arm means; and operator control means connected to said driving means and responsive to the operator for automatically actuating said driving means to close said elevator on said drill stems and pipes.

6. In a drilling rig according to claim 5 wherein said pivoting means further comprises a pivot joint located along said arm between said ball and socket and said mounting means.

7. In a drilling rig according to claims 1 or 2 wherein said driving means is pneumatic.

8. In a drilling rig according to claim 7 wherein said pneumatic driving means comprises air pots associated with said arm means for moving said arm means forward to close said elevator, said air pots having plungers in contact with said arm means to drive said arm means forward.

9. In a drilling rig according to claim 8 wherein said operator control means comprises an air hose connected to said air pots and extending to the vicinity of the operator for supplying air to said air pots in response to operator action.

* * * * *